US006939204B2

(12) United States Patent
Moriya

(10) Patent No.: US 6,939,204 B2
(45) Date of Patent: Sep. 6, 2005

(54) ABRASIVE MACHINE AND METHOD OF ABRADING WORK PIECE

(75) Inventor: Norihiko Moriya, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 10/691,898

(22) Filed: Oct. 23, 2003

(65) Prior Publication Data

US 2004/0082273 A1 Apr. 29, 2004

(30) Foreign Application Priority Data

Oct. 25, 2002 (JP) ..... 2002-310467

(51) Int. Cl.[7] ..... B24B 1/00

(52) U.S. Cl. ..... 451/36; 451/60; 438/692; 216/89

(58) Field of Search ..... 451/36, 41, 60; 156/345.11–345.17; 438/690–693; 216/38, 52, 83, 88, 89, 90, 92

(56) References Cited

U.S. PATENT DOCUMENTS 6,413,149 B1 * 7/2002 Wada et al. ..... 451/41
6,641,462 B2 * 11/2003 Eaton ..... 451/41
6,652,366 B2 * 11/2003 Dyer ..... 451/60
6,706,140 B2 * 3/2004 Hsu et al. ..... 156/345.13
6,722,949 B2 * 4/2004 Hu et al. ..... 451/36

FOREIGN PATENT DOCUMENTS

| | | |
|---|---|---|
| JP | 58-171825 | 10/1983 |
| JP | 06-055436 | 3/1994 |
| JP | 09-066448 | 3/1997 |
| JP | 11-226864 | 8/1999 |
| JP | 11-262862 | 9/1999 |

* cited by examiner

*Primary Examiner*—David B. Thomas
(74) *Attorney, Agent, or Firm*—Jordan and Hamburg LLP

(57) ABSTRACT

The abrasive machine is capable of feeding a proper amount of slurry and preventing a work piece from sticking on an upper abrasive plate. The abrasive machine comprises: the upper abrasive plate abrading an upper face of the work piece and having a plurality of slurry holes for feeding the slurry to the work piece; a lower abrasive plate abrading a lower face of the work piece; a slurry feeding unit pressurizing and feeding the slurry; a plurality of slurry paths respectively connecting the slurry holes to the slurry feeding unit; a plurality of valve mechanisms respectively provided to the slurry paths so as to control flows of the slurry; and a control section for controlling the valve mechanisms.

20 Claims, 3 Drawing Sheets

ABRASIVE MACHINE AND METHOD OF ABRADING WORK PIECE

BACKGROUND OF THE INVENTION

The present invention relates to an abrasive and a method of abrading a work piece, more precisely relates to an abrasive machine, which has an upper abrasive plate and a lower abrasive plate for abrading both faces of a work piece, and a method of abrading a work piece with said machine.

In a conventional abrasive machine having an upper and a lower abrasive plates, a work piece is sandwiched between the abrasive plates, and the abrasive plates are rotated in the opposite directions with feeding slurry to the work piece, so that both faces of the work piece can be abraded. The conventional abrasive machine (see Japanese Patent Gazette No. 11-262862) is shown in FIG. 5. The abrasive machine includes: an upper abrasive plate 10 and a lower abrasive plate 12, which are rotated in the opposite directions; a sun gear 14: an internal gear 16; and carriers 18. The carriers 18 are provided between the abrasive plates 10 and 12, and a gear (not shown), which engages with the sun gear 14 and the internal gear 16, is formed along an outer edge of each carrier 18. With this structure, the carriers 18 are capable of spinning about their own axes and orbiting along the internal gear 16. By rotating the abrasive plates 10 and 12, upper faces and lower faces of work pieces 20, which are respectively held in through-hole of the carriers 18, can be abraded by the abrasive plates 10 and 12.

The lower abrasive plate 12 is held by a lower holder 22, and the lower holder 22 is rotatably supported by a base 24. The lower holder 22 is rotated by a rotary shaft 22*a*, so that the lower abrasive plate 12 is rotated. The upper abrasive plate 10 is rotated by a drive shaft 26 and engaging members 28 and 29.

The sun gear 14 is rotated by a rotary shaft 30. A casing 32 supports the internal gear 16.

In the abrasive machine shown in FIG. 5, a plate 40 is provided above the upper abrasive plate 10, a slurry ring 42, whose sectional shape is a U-shape, is provided to the plate 40, and connecting pipes 44 and connecting tubes 46 are connected to the slurry ring 42, so that the slurry ring 42 is communicated with slurry holes 48 formed in the upper abrasive plate 10. Valves 50 for controlling amount of flow are respectively provided to the connecting tubes 46. The plate 40 is rotated in one direction together with the upper abrasive plate 10, and slurry supplied to the slurry ring 42 is fed to the work pieces 20 via the connecting pipes 44, the connecting tubes 46 and the slurry holes 48. The valves 50 adjust amount of the slurry fed to the slurry holes 48. For example, much slurry is fed to the slurry holes 48 near the center of the upper abrasive plate 10.

In the conventional abrasive machine, the slurry is uniformly fed to the work pieces 20 by adjusting the amount of the slurry supplied to the slurry holes 48 of the upper abrasive plate 10. However, as shown in FIG. 5, the slurry flows downward from the slurry ring 42 by gravity or own weight. Therefore, it is difficult to control the amount of the slurry because the slurry holes 48 must be properly selected and the flow of the slurry must be precisely controlled.

In the abrasive machine, the upper abrasive plate 10 is lifted or moved upward until reaching an uppermost position when the work pieces 20 are exchanged, maintenance is taken place, etc. At that time, some work pieces 20 stuck on an abrasive face of the upper abrasive plate 10 are lifted together with the upper abrasive plate 10. If the work pieces 20 are lifted together with the upper abrasive plate 10, the work piece 20 fall therefrom, and they are damaged. These days, the work pieces 20 are large and thin, so they are apt to be stuck on the upper abrasive plate 10. Especially, in the abrasive machine capable of automatically feeding and removing work pieces, sticking the work pieces onto the upper abrasive plate must be prevented.

To solve the problem of sticking work pieces onto an upper abrasive plate, some methods have been proposed. For example, mist of a fluid is jetted from the upper abrasive plate to work pieces (see Japanese Patent Gazette No. 11-226864); jet holes are formed in the upper abrasive plate, and high pressure air is jetted from the jet holes toward work pieces so as to peel off the work pieces (see Japanese Patent Gazette No. 9-66448); an ejecting member, which is usually located away from the upper abrasive plate, is actuated to mechanically eject work pieces from the upper abrasive plate (see Japanese Patent Gazette No. 6-55436); a compressed fluid, e.g., compressed air, is jetted from the upper abrasive plate so as to peel off work pieces (see Japanese Patent Gazette No. 58-171825).

However, even if jet holes for jetting a compressed fluid are formed in the upper abrasive plate so as to peel off work pieces, the jet holes are independent of the slurry holes. Thus, if arrangement of the slurry holes has priority over that of the jet holes, the arrangement of the jet holes are restricted so that the jet holes cannot be located at ideal positions. Further, in the abrasive machines capable of abrading various types of work pieces, jet holes cannot be always located at ideal positions because the positions of the jet holes are fixed.

SUMMARY OF THE INVENTION

The present invention has been invented to solve the above described problems of the conventional abrasive machines.

An object of the present invention is to provide an abrasive machine capable of feeding a proper amount of slurry according to arrangement of a work piece so as to precisely abrade the work piece and preventing the work piece from sticking on an upper abrasive plate so as to automatically feeding and removing the work piece.

Another object of the present invention is to provide a method of abrading a work piece with the abrasive machine of the present invention.

To achieve the object, the present invention has following structures.

The abrasive machine of the present invention comprises:

an upper abrasive plate rotating to abrade an upper face of a work piece, the upper abrasive plate having a plurality of slurry holes for feeding slurry to the work piece;

a lower abrasive plate rotating to abrade a lower face of the work piece, the lower abrasive plate sandwiching the work piece with the upper abrasive plate so as to abrade the both faces of the work piece;

a slurry feeding unit pressurizing and feeding the slurry;

a plurality of slurry paths respectively connecting the slurry holes to the slurry feeding unit;

a plurality of valve mechanisms being respectively provided to the slurry paths so as to control flows of the slurry; and a control section for controlling the valve mechanisms.

In the abrasive machine, the control section may control degree of opening the valve mechanisms so as to control feeding the slurry to each of the slurry holes.

In the abrasive machine, the slurry feeding unit may be a pressurizing unit capable of feeding the slurry with fixed pressure, the pressurizing unit may be connected to the slurry holes by a distributor, and the valve mechanisms may be electromagnetic valves.

The abrasive machine may further comprise:

a carrier having a through-hole in which the work piece is set so as to abrade the both faces of the work piece, the carrier being provided between the upper abrasive plate and the lower abrasive plate;

a carrier holder holding an outer edge of the carrier; and a crank mechanism for orbiting the carrier holder.

The abrasive machine may further comprise:

a shaft being connected to the upper abrasive plate;

a rotating mechanism for rotating the shaft; and a slurry feeding tube being provided in the shaft, wherein the slurry paths are connecting tubes respectively connecting the slurry holes to the slurry feeding tube.

In the abrasive machine, the shaft may include a water path for feeding water for cooling the upper abrasive plate.

The abrasive machine may further comprise:

a carrier having a through-hole in which the work piece is set so as to abrade the both faces of the work piece, the carrier being provided between the upper abrasive plate and the lower abrasive plate;

a sun gear engaging with an outer edge of the carrier; and an internal gear engaging with the outer edge of the carrier, wherein the carrier spins and orbits along the internal gear.

The abrasive machine may further comprise:

a supporting plate being provided to the upper abrasive plate, the supporting plate supporting a distributor; and a plurality of connecting tubes respectively connecting the slurry holes to the distributor.

The method of the present invention is a method of abrading a work piece in a machine comprising:

an upper abrasive plate rotating to abrade an upper face of a work piece, the upper abrasive plate having a plurality of slurry holes for feeding slurry to the work piece;

a lower abrasive plate rotating to abrade a lower face of the work piece, the lower abrasive plate sandwiching the work piece with the upper abrasive plate so as to abrade the both faces of the work piece;

a slurry feeding unit pressurizing and feeding the slurry;

a plurality of slurry paths respectively connecting the slurry holes to the slurry feeding unit;

a plurality of valve mechanisms respectively provided to the slurry paths so as to control flows of the slurry; and a control section for controlling the valve mechanisms, the control section controlling the valve mechanisms so as to control amount of the slurry fed from the slurry feeding unit to each of the slurry holes while abrading the work piece.

In the method, the control section may feed the slurry via the selected slurry hole so as to remove the work piece from the upper abrasive plate by liquid pressure when the upper abrasive plate is moved away from the lower abrasive plate.

By employing the abrasive machine and the method of the present invention, the slurry can be properly fed to the work piece, so that the work piece can be abraded precisely. Since the control section controls the valve mechanisms of the slurry paths, amount of the slurry fed via each slurry hole can be controlled so that various types of work pieces can be properly abraded. Further, the slurry can be jetted toward the work piece from the slurry holes, so that the work piece can be securely removed from the upper abrasive plate. Therefore, damaging the work piece can be prevented when the upper abrasive plate is moved upward, and reliability of the machine can be improved.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
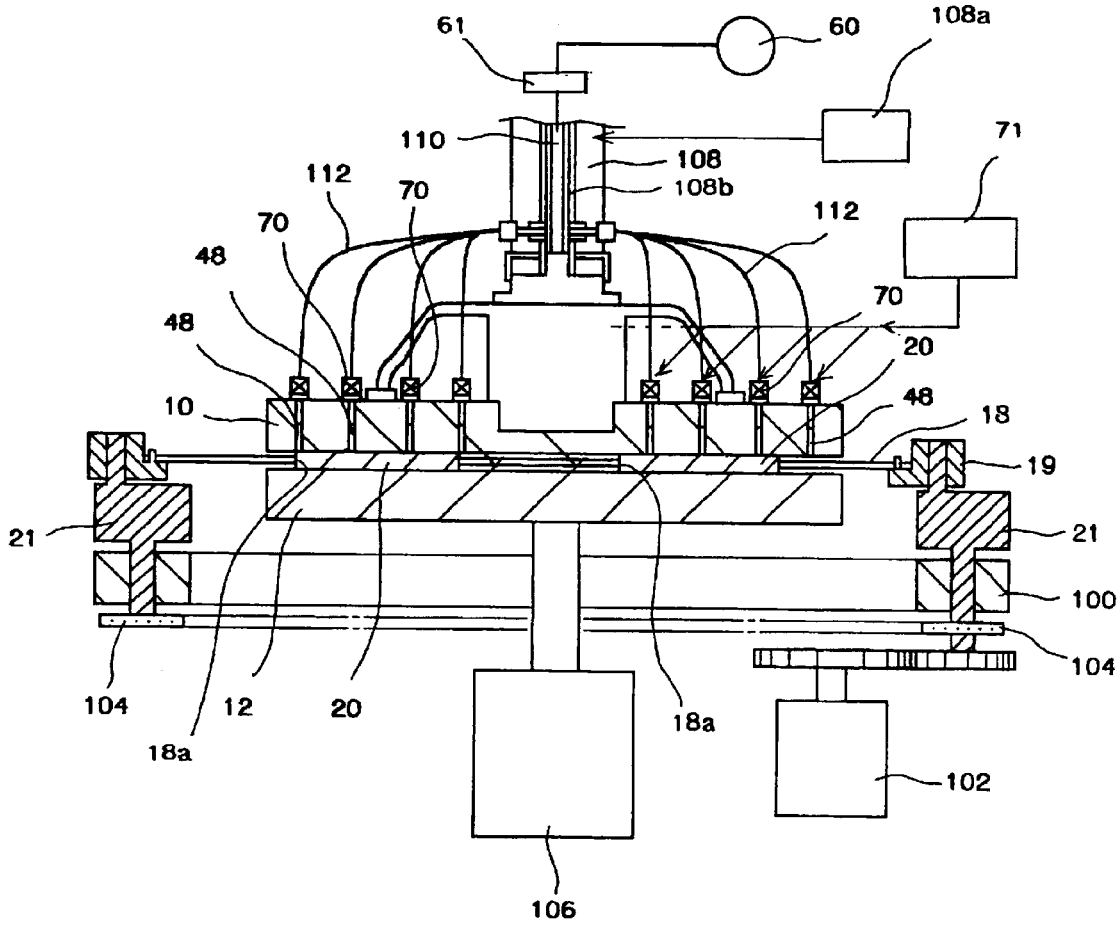
FIG. 1 is a sectional view of the abrasive machine of a first embodiment of the present invention.

FIG. 1 is a sectional view of a main part of an abrasive machine of a first embodiment. A symbol 10 stands for an upper abrasive plate; a symbol 12 stands for a lower abrasive plate; a symbol 18 stands for a carrier; and symbols 20 stand for work pieces. The work pieces 20 are respectively set in through-holes 18*a* of the carrier 18.

An outer edge of the carrier 18 is supported by a carrier holder 19, and the carrier holder 19 engages with cranks 21, which are rotatably held by a base 100. The cranks 21 are circularly provided along an outer edge of the base 100 with regular separations. The cranks 21 are connected to a motor 102 with sprockets 104, so that the cranks 21 can be rotated synchronously.

When the motor 102 synchronously rotates the cranks 21, the carrier 18 is orbited without spinning about its own axis. Therefore, the work pieces 20 held by the carrier 18 are also orbited together with the carrier 18, so that upper faces and lower faces of the work pieces 20, which have been sandwiched or clamped between the abrasive plates 10 and 12, can be abraded simultaneously.

The lower abrasive plate 12 is rotated by a motor 106. A splined shaft 108 is connected to a center of the upper abrasive plate 10. The shaft 108 is rotated by a driving mechanism (motor) 108*a* for rotating the upper abrasive plate 10. The upper abrasive plate 10 and the lower abrasive plate 12 are rotated in the opposite directions by the motor 106 and the driving mechanism 108*a*.

Slurry holes 48 are through-holes vertically extending in the upper abrasive plate 10. A pipe 110 for feeding slurry and a water path 108*b*, through which water for cooling the upper abrasive plate 10 is supplied, are formed in the shaft 108. The pipe 110 is communicated to the slurry holes 48 by connecting tubes 112 respectively. With this structure, the slurry supplied to the pipe 110 can be fed to each slurry hole 48 via the connecting tube 112.

A characteristic point of the abrasive machine of the first embodiment is that the slurry is pressurized when it is supplied to the work pieces 20. A pressurizing unit (slurry feeding unit) 60 pressurizes the slurry and sends it to the pipe 110. A distributor 61 is provided to an upper end of the shaft 108, communicated to the pipe 110 and liquid-tightly sealed by a rotary seal unit (not shown). The slurry feeding unit 60 is communicated to the pipe 110 via the distributor 61. By communicating the slurry feeding unit 60 to the pipe 110 via the distributor 61, the slurry can be always supplied while the upper abrasive plate 10 is rotated. Note that, the cooling water is also supplied and discharged via the distributor 61.

In the first embodiment, adjust valves 70, which act as valve mechanisms, respectively correspond to the slurry holes 48 of the upper abrasive plate 10. Flows of the slurry from the slurry feeding unit 60 to the slurry holes 48 are respectively controlled by the valves 70.

The valves 70 are, for example, electromagnetic valves, and degree of opening the valves 70 are respectively controlled by a control section 71. By controlling the degree of opening the valves 70, amount of feeding the slurry can be controlled; by closing the valves 70, feeding the slurry can be stopped. The valves 70 can be optionally controlled while the abrasive plates 10 and 12 abrade the work pieces 20.

Figure 2:
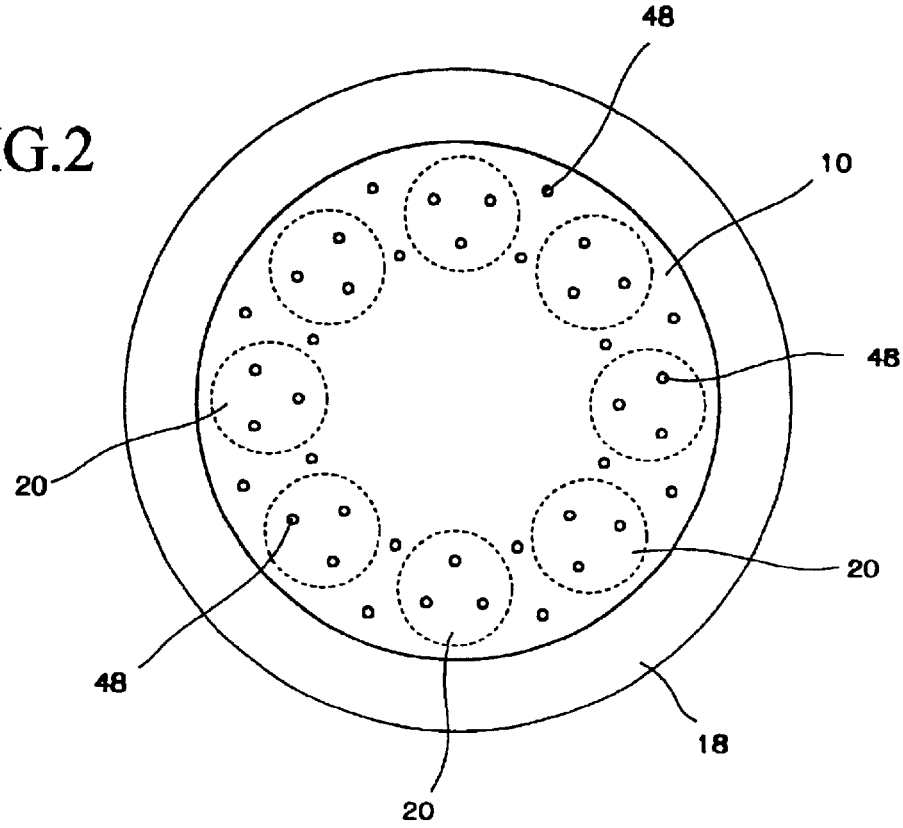
FIG. 2 is an explanation view showing an arrangement of slurry holes formed in an upper abrasive plate of the first embodiment.

A planar arrangement of the upper abrasive plate 10, the carrier 18 and the work pieces 20 is shown in FIG. 2. In the present embodiment, the work pieces 20 are semiconductor wafers, and eight wafers 20 are arranged in the circumferential direction. As described above, the work pieces 20 are set in the through-holes 18*a* of the carrier 18. The work pieces 20 are orbited and abraded with the orbital movement of the carrier 18.

A plurality of the slurry holes 48 are formed in the upper abrasive plate 10 as shown in FIG. 2. The slurry is fed to the work pieces 20 via the slurry holes 48 respectively.

Positions of the slurry holes 48 in the upper abrasive plate 10 are fixed; relative positions of the slurry holes 48 with respect to the work pieces 20 are varied with the orbital movement of the carrier 18 when the work pieces 20 are abraded. In FIG. 2, the carrier 18 is located at an initial position.

In the first embodiment, the slurry feeding unit 60 pressurizes and sends the slurry, so amount of the slurry fed through each slurry hole 48 can be properly adjusted by controlling each valve 70.

For example, if amount of the slurry fed to an inner part of the upper abrasive plate 10 and that fed to an outer part thereof are different, the valves 70 corresponding to the slurry holes 48 in the inner part and those corresponding to the slurry holes 48 in the outer part are differently controlled so as to uniformly feed the slurry to the whole abrasive plate 10.

Further, the slurry can be fed to selected slurry holes 48 only, and no slurry can be fed to the rest slurry holes 48. Namely, slurry feeding positions in the upper abrasive plate 10 can be controlled.

In the case of the conventional abrasive machine in which the slurry is flowed downward by its own weight, amount of flowing the slurry varies, so it is difficult to precisely control the amount of feeding the slurry. On the other hand, in the abrasive machine of the first embodiment, the slurry feeding unit 60 sends the slurry with applying prescribed pressure. Therefore, the amount of feeding the slurry can be precisely adjusted by controlling the valves 70. This is a unique advantage of the first embodiment.

The amount of feeding the slurry can be adjusted at each slurry hole 48, further the electromagnetic valves 70, which respectively correspond to the slurry holes 48, can be independently turned on and off, so a method of feeding the slurry can be precisely controlled according to types of the work pieces 20, etc. Therefore, precise abrasion can be performed.

In the first embodiment, the valves 70 can be controlled while operating the abrasive machine, so the amount of feeding the slurry can be controlled with progress of the abrasion. For example, the amount of feeding the slurry can be gradually increased or reduced with the progress of abrasion. In this case, the slurry can be effectively consumed. Further, the amount of feeding the slurry may be adjusted according to conditions of the work pieces 20, the abrasive plates 10 and 12, etc.

In the first embodiment, a shape of an abrasive face of the upper abrasive plate 10 can be controlled by the pressure of the slurry. For example, if temperature of the upper abrasive plate 10 rises and the shape of the abrasive face thereof is deviated from a prescribed shape, the shape of the abrasive face can be corrected by adjusting the pressure of the slurry. Since the slurry feeding unit 60 sends the slurry with the fixed pressure, the pressure of the slurry, which jets out from the slurry holes 48 and works to the abrasive face of the abrasive plate 10, is adjusted by the valves 70.

When the abrasion is completed, the upper abrasive plate 10 is lifted or moved upward so as to transfer the work pieces 20 abraded. At that time, the slurry is jetted toward the work pieces 20 so as to securely eject the work pieces from the abrasive face of the upper abrasive plate 10.

If the carrier 18 returns to the initial position when the abrasion is completed, the slurry may be jetted out from the specific slurry holes 48, which have been previously selected, when the upper abrasive plate 10 is moved upward.

In the conventional abrasive machine, the work pieces are ejected by a compressed fluid, e.g., compressed air. On the other hand, in the first embodiment, the slurry for ejecting the work pieces 20 from the upper abrasive plate 10 and the slurry for abrading the work pieces 20 are the same slurry. Therefore, the work pieces 20 are not badly influenced by the slurry for ejecting.

A second embodiment of the abrasive machine of the present invention will be explained with reference to FIGS. 3 and 4.

Figure 3:
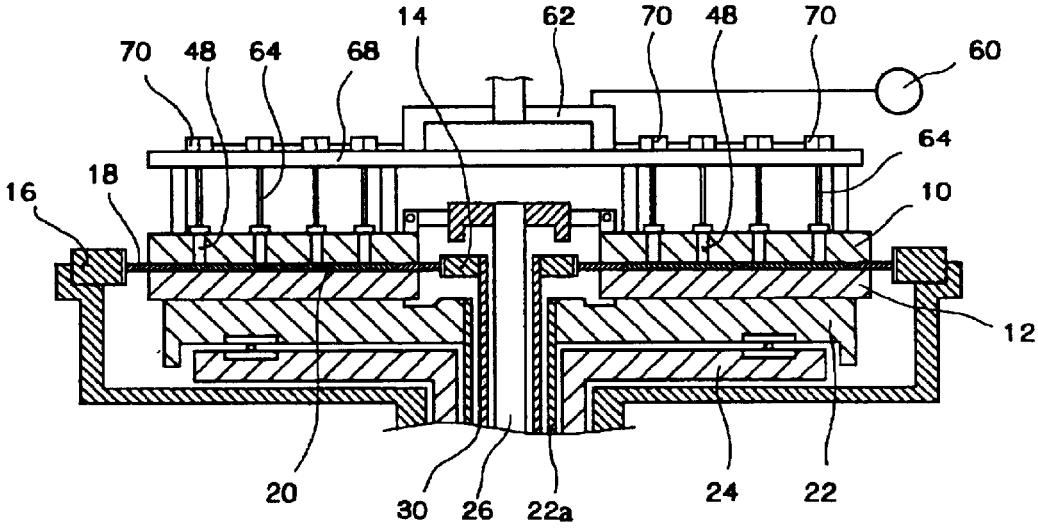
FIG. 3 is a sectional view of the abrasive machine of a second embodiment.

In FIG. 3, a symbol 10 stands for an upper abrasive plate; a symbol 12 stands for a lower abrasive plate; and symbols 18 stand for carriers, which are spun and orbited by a sun gear 14 and an internal gear 16. Work pieces 20 are held in each carrier 18 and sandwiched or clamped between the abrasive plates 10 and 12. An upper face and the lower face of the work pieces 20 are simultaneously abraded by the abrasive plates 10 and 12 with the spin and the orbital movement of the carriers 18.

Figure 5:
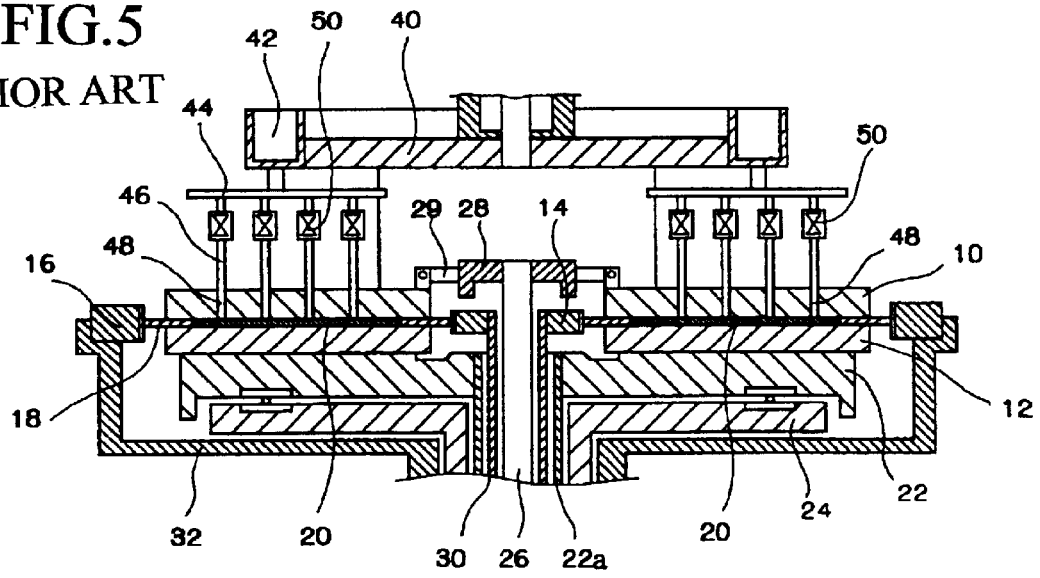
FIG.5 PRIOR ART
FIG. 5 is a sectional view of the conventional abrasive machine.

The abrasive machine has a lower holder 22, a base 24, a rotary shaft 22*a* of the lower holder 22, a drive shaft 26 for rotating the upper abrasive plate 10, a shaft 30 for rotating the sun gear 14, etc. as well as the conventional abrasive machine shown in FIG. 5. Therefore, they are assigned the same symbols and explanation will be omitted.

A slurry feeding unit 60 pressurizes and sends the slurry. A distributor 62 is communicated to the slurry feeding unit 60, and slurry holes 48 of the upper abrasive plate 10 are respectively communicated to the distributor 62 via connecting tubes 64. A support plate 68 is provided to the upper abrasive plate 10, and valves 70 are provided to the support plate 68. The valves 70 respectively correspond to the connecting tubes 64 so as to control amount of the slurry fed to each slurry hole 48.

In the second embodiment, the valves 70 are provided to the support plate 68 of the upper abrasive plate 10, means for holding the valves 70 is not limited to the present manner.

Figure 4:
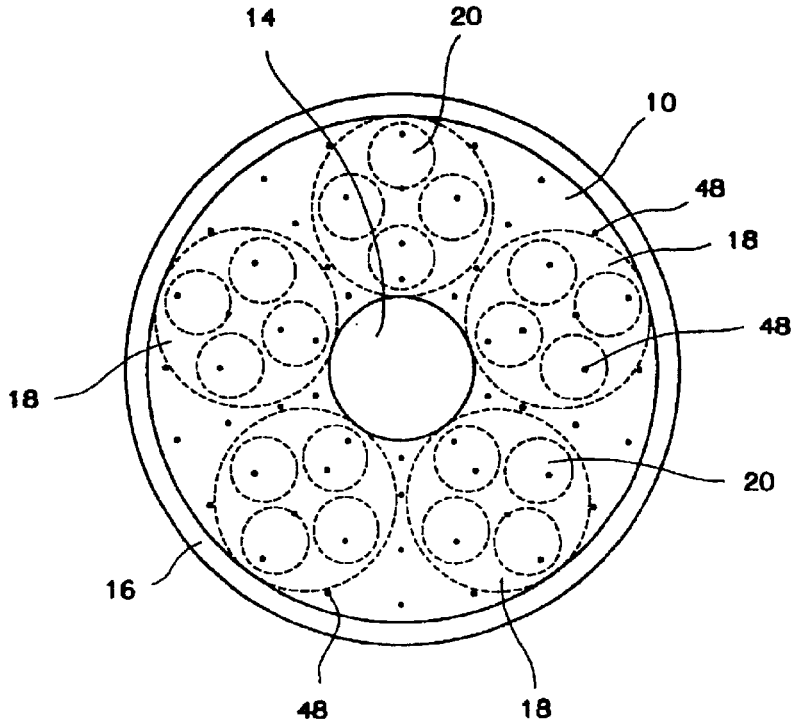
FIG. 4 is an explanation view showing an arrangement of the slurry holes formed in the upper abrasive plate of the second embodiment.

A planar arrangement of the slurry holes 48 is shown in FIG. 4. In FIG. 4, the carriers 18 are located at initial positions.

In the second embodiment too, amount of feeding the slurry to each slurry hole 48 of the upper abrasive plate 10 can be precisely adjusted by the valves 70, which are controlled by a control section as well as the first embodiment. Therefore, the work pieces 20 can be precisely abraded. By adjusting the amount of feeding the slurry to each slurry hole 48, the abrasive machine can properly abrade many types of work pieces. The amount of feeding the slurry to each slurry hole 48 may be defined according to types of work pieces, etc.

In the second embodiment too, if amount of the slurry fed to an inner part of the upper abrasive plate 10 and that fed to an outer part thereof are different, the valves 70 corresponding to the slurry holes 48 in the inner part and those corresponding to the slurry holes 48 in the outer part are differently controlled so as to uniformly feed the slurry to the whole abrasive plate 10. The valves 70 can be controlled while operating the abrasive machine, so the amount of feeding the slurry may be controlled with progress of the abrasion. A shape of an abrasive face of the upper abrasive plate 10 may be corrected by adjusting the pressure of the slurry. When the abrasion is completed and the upper abrasive plate 10 is moved upward, the slurry may be jetted toward the work pieces 20 so as to securely eject the work pieces from the abrasive face of the upper abrasive plate 10.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. An abrasive machine, comprising:

an upper abrasive plate rotating to abrade an upper face of a work piece, said upper abrasive plate having a plurality of slurry holes for feeding slurry to the work piece;

a lower abrasive plate rotating to abrade a lower face of the work piece, said lower abrasive plate sandwiching the work piece with said upper abrasive plate so as to abrade the both faces of the work piece;

a slurry feeding unit pressurizing and feeding the slurry;

a plurality of slurry paths respectively connecting the slurry holes to said slurry feeding unit;

a plurality of valve mechanisms being respectively provided to said slurry paths so as to control flows of the slurry; and a control section for controlling said valve mechanisms.

2. The abrasive machine according to claim 1, wherein said control section controls degree of opening said valve mechanisms so as to control feeding the slurry to each of the slurry holes.

3. The abrasive machine according to claim 1, wherein said slurry feeding unit is a pressurizing unit capable of feeding the slurry with fixed pressure, said pressurizing unit is connected to the slurry holes by a distributor, and said valve mechanisms are electromagnetic valves.

4. The abrasive machine according to claim 1, further comprising:

a carrier having a through-hole in which the work piece is set so as to abrade the both faces of the work piece, said carrier being provided between said upper abrasive plate and said lower abrasive plate;

a carrier holder holding an outer edge of said carrier; and a crank mechanism for orbiting said carrier holder.

5. The abrasive machine according to claim 4, further comprising:

a shaft being connected to said upper abrasive plate;

a rotating mechanism for rotating said shaft; and a slurry feeding tube being provided in said shaft, wherein said slurry paths are connecting tubes respectively connecting the slurry holes to said slurry feeding tube.

6. The abrasive machine according to claim 5, wherein said shaft includes a water path for feeding water for cooling said upper abrasive plate.

7. The abrasive machine according to claim 1, further comprising:

a carrier having a through-hole in which the work piece is set so as to abrade the both faces of the work piece, said carrier being provided between said upper abrasive plate and said lower abrasive plate;

a sun gear engaging with an outer edge of said carrier; and an internal gear engaging with the outer edge of said carrier, wherein said carrier spins and orbits along said internal gear.

8. The abrasive machine according to claim 7, further comprising:

a supporting plate being provided to said upper abrasive plate, said supporting plate supporting a distributor; and a plurality of connecting tubes respectively connecting the slurry holes to said distributor.

9. A method of abrading a work piece in a machine comprising:

an upper abrasive plate rotating to abrade an upper face of a work piece, said upper abrasive plate having a plurality of slurry holes for feeding slurry to the work piece;

a lower abrasive plate rotating to abrade a lower face of the work piece, said lower abrasive plate sandwiching the work piece with said upper abrasive plate so as to abrade the both faces of the work piece;

a slurry feeding unit pressurizing and feeding the slurry;

a plurality of slurry paths respectively connecting the slurry holes to said slurry feeding unit;

a plurality of valve mechanisms respectively provided to said slurry paths so as to control flows of the slurry; and a control section for controlling said valve mechanisms, said control section controlling said valve mechanisms so as to control amount of the slurry fed from said slurry feeding unit to each of the slurry holes while abrading the work piece.

10. The method according to claim 9, wherein said control section feeds the slurry via the selected slurry hole so as to remove the work piece from said upper abrasive plate by liquid pressure when said upper abrasive plate is moved away from said lower abrasive plate.

11. An abrasive machine, comprising:

an upper abrasive plate capable of rotating to abrade an upper face of a work piece, said upper abrasive plate having a plurality of slurry holes therethrough for feeding a slurry to the work piece;

a lower abrasive plate capable of rotating to abrade a lower face of the work piece, said lower abrasive plate sandwiching the work piece with said upper abrasive plate therebetween so as to abrade both the upper and the lower faces of the work piece;

a slurry pressurizing and feeding unit for pressurizing and feeding the slurry;

a plurality of slurry paths connecting the slurry holes to said slurry pressurizing and feeding unit;

a plurality of valves in said slurry paths for controlling flows of the slurry; and a control section for controlling said valves, such that slurry is fed only through predetermined slurry paths to slurry holes which are in communication with a particular workpiece based on a size and shape of said particular workpiece, and such that a flow of slurry through any slurry path to a corresponding slurry hole is capable of being independently regulated and can be varied over time during performance of an abrasion process on said workpiece.

12. The abrasive machine according to claim 11, wherein said control section controls opening and closing of said valves to control feeding slurry to the slurry holes.

13. The abrasive machine according to claim 11, wherein said slurry pressurizing and feeding unit is capable of feeding the slurry at a fixed pressure, said slurry pressurizing and feeding unit is connected to the slurry holes by a distributor, and said valves are electromagnetic valves.

14. The abrasive machine according to claim 11, further comprising:

a carrier, positioned between said upper abrasive plate and said lower abrasive plate, and having a through-hole in which the work piece is set so as to abrade both the upper and the lower faces of the work piece;

a carrier holder for holding an outer edge of said carrier; and a crank mechanism for orbiting said carrier holder.

15. The abrasive machine according to claim 14, further comprising:

a shaft connected to said upper abrasive plate;

a rotating mechanism for rotating said shaft; and a slurry feeding tube in said shaft;

wherein said slurry paths connect with a plurality of tubes which respectively connect the slurry holes to said slurry feeding tube.

16. The abrasive machine according to claim 15, wherein said shaft includes a water path for feeding water for cooling said upper abrasive plate.

17. The abrasive machine according to claim 11, further comprising:

a carrier, positioned between said upper abrasive plate and said lower abrasive plate, and having a through-hole in which the work piece is set so as to abrade both the upper and the lower faces of the work piece;

a sun gear engaging with an outer edge of said carrier; and an internal gear engaging with the outer edge of said carrier;

wherein said carrier spins and orbits along said internal gear.

18. The abrasive machine according to claim 17, further comprising:

a distributor;

a supporting plate in communication with said upper abrasive plate, for supporting said distributor; and a plurality of connecting tubes connecting the slurry holes to said distributor.

19. A method of abrading a work piece in a machine, said method comprising:

placing a work piece having an upper face and a lower face in said machine, said workpiece being sandwiched between an upper abrasive plate capable of rotating to abrade said upper face of the work piece, and a lower abrasive plate capable of rotating to abrade said lower face of said workpiece;

pressurizing a slurry to be fed to said workpiece;

feeding said pressurized slurry to said workpiece through a plurality of slurry paths connected to a plurality of slurry holes in said upper abrasive plate, while rotating said upper abrasive plate and said lower abrasive plate; and controlling a flow amount of pressurized slurry being fed to said workpiece by controlling a plurality of flow control valves in said plurality of slurry paths.

20. The method according to claim 19 further comprising utilizing liquid pressure of said slurry fed through said slurry holes to remove said workpiece from said upper abrasive plate when, as said upper abrasive plate and said lower abrasive plate are retracted from said workpiece after completion of abrasion of said workpiece, said workpiece adheres to said upper abrasive plate.

* * * * *